United States Patent [19]
Maurer et al.
[11] 4,253,885
[45] Mar. 3, 1981

[54] TREATING NICKEL BASE ALLOYS

[75] Inventors: Gernant E. Maurer, New Hartford; William J. Boesch, Utica, both of N.Y.

[73] Assignee: Special Metals Corporation, New Hartford, N.Y.

[21] Appl. No.: 70,584

[22] Filed: Aug. 29, 1979

[51] Int. Cl.[3] ..... C22F 1/10
[52] U.S. Cl. ..... 148/13.1; 148/31.5; 148/162
[58] Field of Search ..... 148/13.1, 162, 31.5, 148/32.5

[56] References Cited

U.S. PATENT DOCUMENTS

| | | | |
|---|---|---|---|
| 3,653,987 | 4/1972 | Boesch | 148/162 |
| 4,083,734 | 4/1978 | Boesch | 148/162 |
| 4,093,476 | 6/1978 | Boesch | 148/32.5 |

*Primary Examiner*—R. Dean
*Attorney, Agent, or Firm*—Vincent G. Gioia

[57] ABSTRACT

A method of heat treating and coating a nickel base alloy containing chromium, titanium, aluminum, cobalt, molybdenum, tungsten, boron and carbon. The alloy is heated at a temperature of at least 2050° F. to put most of the coarse gamma prime particles into solution; coated; treated at a temperature of at least 1600° F. to lessen the sharp differential in chemistry between it and the coating at the interface thereof; treated within the temperature range of between 1500° and 1800° F. to precipitate fine gamma prime particles, to coarsen existing gamma prime particles and to precipitate discrete carbide particles; and treated at a temperature within the range of between 1300° and 1500° F. to precipitate additional fine gamma prime particles, and discrete carbide particles at grain boundaries.

10 Claims, No Drawings

TREATING NICKEL BASE ALLOYS

The present invention relates to a method for heat treating and coating a nickel-base superalloy.

Most superalloys are variations of the basic nickel-chromium matrix containing varying amounts of titanium and aluminum, hardened by $\gamma'[Ni_3(Al, Ti)]$, with optional additions such as cobalt, molybdenum, tungsten, boron and zirconium. Two such superalloys are disclosed in U.S. Pat. Nos. 4,083,734 and 4,093,476. Each of these alloys are characterized by a highly desirable combination of hot corrosion resistance, hot impact resistance, strength, creep resistance, phase stability and stress rupture life.

As alloys such as those disclosed in U.S. Pat. Nos. 4,083,734 and 4,093,476 are often coated with a dissimilar alloy to enhance their value and are usually heat treated to develop gamma prime particles of a desirable and beneficial morphology; it would be desirable to develop a precipitation hardening heat treatment which incorporates a coating operation. Obvious problems can occur when these alloys are coated prior to or subsequent to heat treating.

Through the present invention there is provided a series of operations through which the alloys of U.S. Pat. Nos. 4,083,734 and 4,093,476, are simultaneously heat treated and coated. The alloys are coated with a dissimilar alloy which enhances their value while being heat treated to develop gamma prime particles of a desirable and beneficial morphology. A coating operation has been successfully incorporated into a precipitation hardening heat treatement.

Heat treatments for a dissimilar class of nickel-base superalloys are disclosed in U.S. Pat. No. 3,653,987. One of the treatments comprises the steps of: (1) heating at a temperature of 2135° F. for 4 hours and cooling; (2) heating at a temperature of 1975° F. for 4 hours and cooling; (3) heating at a temperature of 1550° F. for 24 hours and cooling; and (4) heating at a temperature of 1400° F. for 16 hours and cooling. Another, differs from the first in that it utilizes a lower temperature during the second stage of the treatment. The maximum second stage temperature is 1850° F. A coating operation is not, however, a part of either of these treatments. U.S. Pat. No. 3,653,987 does not disclose a precipitation hardening heat treatment which incorporates a coating operation.

Treatments similar to that disclosed in U.S. Pat. No. 3,653,987, are disclosed in heretofore referred to U.S. Pat. Nos. 4,083,734 and 4,093,746. As with U.S. Pat. No. 3,653,987, U.S. Pat. Nos. 4,083,734 and 4,093,746 do not disclose a process wherein a coating operation is incorporated within a precipitation hardening heat treatment.

It is accordingly an object of the present invention to provide a precipitation hardening heat treatment which incorporates a coating operation.

The present invention provides a method for heat treating and coating nickel base alloys consisting essentially of, by weight, from 12.0 to 20.0% chromium, from 4.0 to 7.0% titanium, from 1.2 to 3.5% aluminum, from 12.0 to 20.0% cobalt, from 2.0 to 4.0% molybdenum, from 0.5 to 2.5% tungsten, from 0.005 to 0.048% boron, from 0.005 to 0.15% carbon, up to 0.75% manganese, up to 0.5% silicon, up to 1.5% hafnium, up to 0.1% zirconium, up to 1.0% iron, up to 0.2% of rare earth elements that will not lower the incipient melting temperature below the solvus temperature of the gamma prime present in the alloy, up to 0.1% of elements from the group consisting of magnesium, calcium, strontium and barium, up to 6.0% of elements from the group consisting of rhenium and ruthenium, balance essentially nickel; with the titanium and aluminum content being from 6.0 to 9.0% in a titanium to aluminum ratio of from 1.75:1 to 3.5:1. The method comprises the steps of heating the alloy at a temperature of at least 2050° F.; coating the alloy; treating (heating) the coated alloy at a temperature of at least 1600° F.; treating the alloy within the temperature range of between 1500° and 1800° F.; cooling the alloy; and treating the alloy within the temperature range of between 1300° and 1500° F. In a particular embodiment, the alloy has at least 0.031% boron as boron within the range of from 0.031 to 0.048% has been found to improve stress rupture life. In another embodiment the alloy has at least 0.015% zirconium as zirconium has been found to further improve stress rupture properties. Carbon levels are preferably kept below 0.045% as the alloys impact strength has been found to deteriorate at higher levels, after prolonged high temperature service exposure.

The alloy is heated at a temperature of at least 2050° F. for the primary purpose of putting most of the coarse gamma prime particles into solution. Temperatures employed are usually in excess of 2100° F. Some carbides and borides are also put into solution during this treatment. Time of treatment cannot be specified for this or any of the other treatments of this invention, as it and they are dependent upon several variables including the specific temperature employed and the size of the alloy being treated.

Coatings can be applied in any number of ways which include plasma spraying, vapor deposition and dipping. Those skilled in the art are well aware of the various coating techniques. As for the coating itself, it is a cobalt, nickel or iron base alloy. A cobalt, nickel or iron base alloy is one in which the primary element is cobalt, nickel or iron. Choice of a particular coating is dependent upon the purpose for which it is to be used. Coatings are applied for a variety of purposes which include hot corrosion resistance, oxidation resistance and wear resistance.

In order to lessen the sharp differentials which exist between the chemistry of the coating and the chemistry of the alloy at the interface thereof, the coated alloy is treated at a temperature of at least 1600° F. to permit the coating to diffuse into the alloy. In general, this temperature is at least 1800° F. It is usually below 2000° F.

A treatment within the temperature range of between 1800° and 2000° F. may optionally be added after the treatment at a temperature of at least 1600° F. and prior to the treatment between 1500° and 1800° F. Randomly dispersed gamma prime particles usually form during such a treatment, along with discrete (as opposed to continuous) carbide ($M_{23}C_6$) and boride ($M_3B_2$) particles at the grain boundaries. This treatment is optional as such particles generally form during the preceding treatment. Temperatures employed during this treatment are usually at least 1900° F.

The alloy is treated within the temperature range of between 1500° and 1800° F. to precipitate fine gamma prime particles, to coarsen existing gamma prime particles and to precipitate discrete carbide particles. Temperatures employed are usually between 1520° and 1600° F.

Treatment within the temperature range of between 1300° and 1500° F. is for the purpose of precipitating additional fine gamma prime particles and discrete carbide particles ($M_{23}C_6$) at the grain boundaries, while substantially precluding gamma prime growth. This treatment is usually within the temperature range of between 1350° and 1450° F.

The following examples are illustrative of several aspects of the invention.

Six samples (Samples A, A', B, B', C, C') of the following chemistry:

| Cr | Ti | Al | Co | Mo | W | C | B | Zr | Ni |
|---|---|---|---|---|---|---|---|---|---|
| 18.0 | 4.94 | 2.54 | 14.8 | 3.10 | 1.29 | 0.034 | 0.035 | 0.026 | Bal |

were treated as follows:

A, A'

2135° F. - 4 Hours - Air Cool
1900° F. - 14 Hours - Furnace Cool*
1975° F. - 4 Hours - Air Cool
1550° F. - 24 Hours - Air Cool
1400° F. - 16 Hours - Air Cool

B, B'

2135° F. - 4 Hours - Air Cool
[1900° F. - 14 Hours - Furnace Cool*
1750° F. - 0.5 Hours - Air Cool
1975° F. - 4 Hours - Air Cool
1750° F. - 0.5 Hours - Air Cool
1925° F. - 1.5 Hours - Air Cool]
1550° F. - 24 Hours - Air Cool
1400° F. - 16 Hours - Air Cool

C, C'

2135° F. - 4 Hours - Air Cool
[1850° F. - 6 Hours - Furnace Heat To*
1900° F. - 8 Hours - Furnace Cool]
1550° F. - 24 Hours - Air Cool
1400° F. - 16 Hours - Air Cool

*simulated coating cycle

The samples were subsequently tested for rupture life at a stress of 20 ksi and a temperature of 1800° F., as well as for elongation and reduction in area. The test results are as follows:

| Sample | Life (hours) | Elongation (%) | Reduction in Area (%) |
|---|---|---|---|
| A | 44.6 | 16.2 | 17.6 |
| A' | 42.9 | 20.4 | 19.7 |
| B | 44.3 | 19.0 | 21.7 |
| B' | 46.2 | 20.0 | 18.9 |
| C | 47.2 | 17.1 | 22.5 |
| C' | 49.7 | 17.3 | 22.8 |

The test results clearly demonstrate that the process of the present invention successfully incorporates a coating cycle into a precipitation hardening heat treatment. Excellent properties are achieved even though a coating cycle is incorporated therein.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A method of heat treating and coating a nickel base alloy consisting essentially of, by weight, from 12.0 to 20.0% chromium, from 4.0 to 7.0% titanium, from 1.2 to 3.5% aluminum, from 12.0 to 20.0% cobalt, from 2.0 to 4.0% molybdenum, from 0.5 to 2.5% tungsten, from 0.005 to 0.048% boron, from 0.005 to 0.15% carbon, up to 0.75% manganese, up to 0.5% silicon, up to 1.5% hafnium, up to 0.1% zirconium, up to 1.0% iron, up to 0.2% of rare earth elements that will not lower the incipient melting temperature below the solvus temperature of the gamma prime present in the alloy, up to 0.1% of elements from the group consisting of magnesium, calcium, strontium and barium, up to 6.0% of elements from the group consisting of rhenium and ruthenium, balance essentially nickel; said titanium plus said aluminum content being from 6.0 to 9.0%, said titanium and aluminum being present in a titanium to aluminum ratio of from 1.75:1 to 3.5:1, said heat treatment being a precipitation hardening heat treatment; said coating operation being incorporated within said heat treatment; said method comprising the steps of: heating said alloy at a temperature of at least 2050° F. to put most of the coarse gamma prime particles into solution; coating said alloy, said coating being a cobalt, nickel or iron base alloy; treating said coated alloy at a temperature of at least 1600° F. to lessen the sharp differential in chemistry between said coating and said alloy at the interface thereof; treating said alloy within the temperature range of between 1500° and 1800° F. to precipitate fine gamma prime particles, to coarsen existing gamma prime particles and to precipitate discrete carbide particles; cooling said alloy; and treating said alloy within the temperature range of between 1300° and 1500° F. to precipitate additional fine gamma prime particles, and discrete carbide particles at grain boundaries.

2. A method according to claim 1, wherein said alloy is treated within the temperature range of between 1800° and 2000° F. to form randomly dispersed gamma prime particles, after said treatment at a temperature of at least 1600° F. and prior to said treatment between 1500° and 1800° F.

3. A method according to claim 2, wherein said treatment after said treatment at a temperature of at least 1600° F. and prior to said treatment between 1500° and 1800° F., is at a temperature of at least 1900° F.

4. A method according to claim 1, wherein said heating to put coarse gamma prime particles into solution is at a temperature of at least 2100° F.

5. A method according to claim 1, wherein said treatment to precipitate fine gamma prime particles, to coarsen existing gamma prime particles and to precipitate discrete carbide particles is within the temperature range of between 1520° and 1600° F.

6. A method according to claim 1, wherein said treatment to precipitate additional fine gamma prime particles, and discrete carbide particles at grain boundaries is within the temperature range of between 1350° and 1450° F.

7. A method according to claim 1, wherein said coated alloy is treated at a temperature in excess of 1800° F. to lessen the sharp differential in chemistry between said coating and said alloy at the interface thereof.

8. A method according to claim 1, wherein said alloy being heat treated and coated has at least 0.031% boron.

9. A method according to claim 1, wherein said alloy being heat treated and coated has at least 0.015% zirconium.

10. A method according to claim 1, wherein said alloy being heat treated and coated has no more than 0.045%.

* * * * *